United States Patent [19]

Schneider et al.

[11] Patent Number: 4,842,062

[45] Date of Patent: Jun. 27, 1989

[54] HYDRAULIC LOCK ALLEVIATION DEVICE, WELL CEMENTING STAGE TOOL, AND RELATED METHODS

[75] Inventors: David E. Schneider; Terry D. Timmerman, both of Houston, Tex.

[73] Assignee: Weatherford U.S., Inc., Houston, Tex.

[21] Appl. No.: 152,934

[22] Filed: Feb. 5, 1988

[51] Int. Cl.[4] ..... E21B 33/16

[52] U.S. Cl. ..... 166/154; 166/156; 166/317

[58] Field of Search ..... 166/153, 154, 156, 164, 166/291, 317; 137/68.1, 71

[56] References Cited

U.S. PATENT DOCUMENTS

| | | | |
|---|---|---|---|
| 2,602,510 | 1/1948 | Baker . | |
| 2,626,177 | 1/1953 | Maxwell et al. | 166/317 X |
| 2,756,828 | 7/1956 | Deily | 166/317 X |
| 2,928,470 | 3/1960 | Baker | 166/154 |
| 3,635,288 | 1/1972 | Lebourg | 166/156 |
| 3,768,556 | 5/1972 | Baker | 166/154 |
| 3,811,500 | 5/1974 | Morrisett et al. | 166/155 |
| 3,842,905 | 4/1974 | Morrisett et al. | 166/154 |
| 3,948,322 | 4/1975 | Baker | 166/289 |
| 4,286,662 | 9/1981 | Page, Jr. | 166/317 |
| 4,487,263 | 12/1982 | Jani | 166/289 |

OTHER PUBLICATIONS

Dowell Schlumberger, Cementing Technology, (1984), "Primary Placement Techniques", Chapter 10, pp. 1–20; Chapter 13, Cementing Equipment, pp. 11–12.

Halliburton Services Sales & Service Catalog 43, Composite Catalog, pp. 2440–2451, (1986–1987).

Weatherford Cementing Program, especially pp. 36–67, (1986).

*Primary Examiner*—William P. Neuder

*Attorney, Agent, or Firm*—Guy McClung

[57] ABSTRACT

An hydraulic lock alleviation device a well cementing stage tool with such a device, and related methods for their use. The device has a channel for transmitting trapped fluid which causes a hydraulic lock from the trapped area to another area. The channel is blocked by a pressure responsive member which ruptures, moves, breaks, or is punctured to permit trapped fluid to glow from the area of hydraulic lock. In one embodiment of a stage tool with such a device, a puncture apparatus can be moved to puncture the pressure responsive member. In other embodiments, a movable piston or spool is mounted in the channel for movement to permit the flow of trapped fluid.

28 Claims, 12 Drawing Sheets

HYDRAULIC LOCK ALLEVIATION DEVICE, WELL CEMENTING STAGE TOOL, AND RELATED METHODS

BACKGROUND OF THE INVENTION

1. Field of the Invention

This invention is directed to wellbore cementing operations and apparatuses and methods for use in such operations and particularly to devices for alleviating hydraulic locks encountered in a wellbore and to cementing tools called stage tools and methods of their use.

2. Description of Prior Art

A drilled wellbore hole is prepared for oil or gas production by cementing casing, liners or similar conduit strings in the wellbore. Cementing is the process of mixing a composition including cement and water and pumping the resulting slurry down through the well casing and into the annulus between the casing and the wellbore. Cementing provides protection from the intermixing of the contents of various production zones which could result in undesirable contamination of produced oil or gas or in contamination of the producing strata.

In the early days of the oil field industry, the shallower wells allowed cementation to be accomplished by pumping a cement slurry down the well casing, out the casing bottom, and back up the annular space between the bore hole and casing. As wells were drilled deeper, the cementing process was accomplished in two or even three stages. Cementing tools, stage tools, or ported collars equipped with internal valving, were needed for multi-stage cementation.

Typically, the internal valving of cementing tools, or stage tools, consist of one or more sliding sleeve valves for the opening and closing of the cement ports before and after a cement slurry has passed through the ports. A variety of plugs are used to aid multi-stage cementing to open and close the correct sleeve valve at the correct time.

Problems have been encountered when two sleeve valves are employed to open and close the cement ports. The sleeve valves are shear-pinned in an upper position with the lowermost sleeve sealing the ports closed for running in the wellbore hole. When stage cementing is desired, an opening plug is moved, or dropped and gravitated, to seat and seal off the lowermost sleeve. Pressure applied at the surface applies enough downward force on the plug and seat arrangement to break the shear pins and shift the lower sleeve valve down, thus opening ports which allow cementing solutions or slurries to flow down the interior of the casing and then through the ports into the annulus between the exterior of the casing and the interior of the wellbore. Cement is pumped down the casing, through the ports and back up the annulus.

As the tail end of the cement slurry is pumped down the casing, a second plug often called a "closing plug" is placed into the casing behind the cement. This plug moves down to seat and seal off the uppermost sleeve valve until sufficient surface casing pressure is applied to break the shear pins holding the sleeve. The upper sleeve and plug shift downward to cover and seal off the ports so that no more solution or slurry passes either into the annulus or back from the annulus. An engaging mechanism can be used to lock the closing sleeve in position.

A problem has been encountered in this operation due to the creation of a hydraulic lock when a seal is established across the ports. When a portion of the solution or slurry ahead of the closing plug is pushed downwardly and the ports close off, this small portion of fluid becomes trapped between the plugs within the stage tool and can flow nowhere. The nearly incompressibile nature of the trapped material does not allow the upper sleeve valve to travel sufficiently downward to engage a positive locking mechanism to prevent a reopening of the ports. If the engaging mechanism does not engage on the upper sleeve valve, internal casing pressure must be held until the cement sets.

In accordance with §1.56 of 37 C.F.R. the following references are disclosed and copies thereof are submitted herewith:

(a) U.S. Pat. Nos. 2,602,510; 2,928,470; 3,811,500; 3,824,905; 3,948,322; 3,768,556; and 4,487,263;

(b) publications including: Dowell Schlumberger, CEMENTING TECHNOLOGY, (1984) "Primary Placement Techniques", Chapter 10, pp. 1–20; Chapter 13, "Cementing Equipment", pp. 11–12; Halliburton Services Sales & Service Catalog 43, COMPOSITE CATALOG, pp. 2440–2451 (1986–1987); Weatherford Cementing Program, especially pp. 36–37 (1986)

U.S. Pat. Nos. 2,928,470 and 2,602,510 disclose a device used in a two-step operation for closing off cementing ports that allows a lower sleeve valve to shift in unison with an upper sleeve valve the instant before a hydraulic lock is effected. This is accomplished by introducing a third shear means to release the lower sleeve valve as the upper sleeve valve lands on its upper side. This configuration has the inherent disadvantage of prematurely shearing the third shear means (and thus fouling it) when the lower sleeve valve impacts with too much force while opening the ports or by excessively high cement pump pressures exerting a sufficient downward force before closing is desired. U.S. Pat. No. 2,602,510 discloses the use of bleeder holes which provide fluid communication between the casing interior and the annulus. Since the holes are relatively small and are always open, they can plug up with cementing particles or well mud particles. Also, because of the design of the ported cementing apparatus and the disposition of its seals, the holes must be small (and hence pluggable), otherwise the seals which are required for proper operation of the tool will not be able to properly seal off the holes. U.S. Pat. No. 2,602,510 discloses a device which has seals which can be permitted to move past the ports. Because of the flow of fluid under pressure through the ports and its impact on a seal, the seal can be damaged in the areas adjacent the ports. This same problem can happen in the prior art devices of U.S. Pat. No. 3,811,500.

U.S. Pat. Nos. 3,811,500 and 3,842,905 disclose a device which uses an opening plug to shift a lower sleeve valve open. As the upper sleeve valve slides to cover and seal flow ports, the closing plug, used to shift the upper sleeve valve closed, imposes a downward force on a rod extending through the opening plug which breaks shear pins holding the rod in place and opens a passage through the opening plug for trapped fluid to exit. This configuration is pressure sensitive to excessively high cement pump pressure which can break the shear pins and cause undesirable premature activation; i.e. the rod is pushed out during the cementing operation rather than at its completion. Also, there is no guarantee the mechanism will be aligned correctly upon the seating of the opening plug, due to the loose fitting characteristics of such a plug and the requirement that the plug go down the casing in a properly aligned configuration. If the plug becomes misaligned the device will not work properly. Because of the sensitivity of the shear pin used to hold the rod in place, it is difficult if not impossible to use a hammer means such as a drill pipe joint to jar a stuck plug—since such jarring will cause premature release of the rod or the plug may become damaged.

U.S. Pat. Nos. 3,768,556 and 3,948,322 disclose a device similar to that of U.S. Pat. No. 2,928,470, but with a metal locking device for holding the various elements of the tool in fixed relation to each other, including holding the opening and closing plugs in fixed relation to each other so that the closing plug at some point no longer pushes down on fluid trapped beneath it, eliminating further hydraulic locking effects.

U.S. Pat. No. 4,487,263 discloses a device which has small apertures which permit flow from the interior of the device, where cementing fluid may be trapped, into a chamber in the device. These holes can be plugged up by cementing fluid or mud and the chamber may not be large enough to hold all the fluid. If the chamber has filled and there is still more fluid trapped between the plugs, there can still be an unwanted hydraulic lock.

The listed publications generally describe well cementing operations and stage tools.

There has long been a need for an effective and efficient cementing stage tool and methods for its use. There has long been a need for a device for alleviating hydraulic locking in a wellbore. There has long been a need for a stage tool which does not activate prematurely, which has ports not subject to unwanted plugging, and which does not require complex engaging mechanisms. Also there has long been a need for such a tool and device which do not damage seals used therein. The present invention recognizes, addresses, and satisfies these long-felt needs.

SUMMARY OF THE INVENTION

The present invention teaches an apparatus for alleviating hydraulic locking; a stage tool with such an apparatus; a stage tool which does not damage seals as do the prior art devices; and methods for using the apparatuses and tools.

An apparatus for alleviating hydraulic locking according to this invention includes a fluid conducting mechanism having a fluid channel which is closed off by a puncturable or rupturable disc or by a movable sealing pin disposed in the channel. The disc is made so that it will rupture in direct response to the pressure of fluid trapped above and in the fluid channel or so that it is punctured by a puncture device positioned adjacent the disc. The puncture device can be acted upon by a portion of an upper sleeve in a stage tool moving to contact and push the puncture device through the disc. In another embodiment a movable spool or sealing pin can be used which can move to permit flow of the trapped fluid. The apparatus can be disposed to permit the trapped fluid to flow from an entrapment space (including but not limited to the space in a stage tool between an opening plug and a closing plug in a well cementing operation) into an adjacent but separately defined space (e.g. the space below an opening plug in a well cementing operation).

A stage tool for cementing operations can advantageously utilize such an apparatus. In one embodiment of such a tool the apparatus can be disposed on a lower opening sleeve where it can be acted upon by an upper closing sleeve. It can be emplaced so that trapped fluid between an opening and closing plug flows into the casing interior below the cementing ports. A diffuser groove can be provided on the tool so that the deleterious effects of fluid flowing to and/or through the cementing ports are reduced or eliminated, thereby preserving O-ring seals and preventing damage to them.

It is therefore an object of the present invention to provide a novel, unobvious, efficient and effective device for alleviating hydraulic locking.

Another object of this invention is the provision of a novel, unobvious, efficient and effective stage tool for well cementing operations.

A further object of this invention is the provision of a stage tool which protects certain of its O-ring seals from damage by high velocity pressurized fluid flow.

An additional object of this invention is the provision of methods of use of such apparatuses and tools.

To one of skill in this art who has the benefit of this invention's teachings other and further objects and advantages will be clear from the following description of preferred embodiments given for the purpose of disclosure, when taken in conjunction with the accompanying drawings.

Figure 1A:
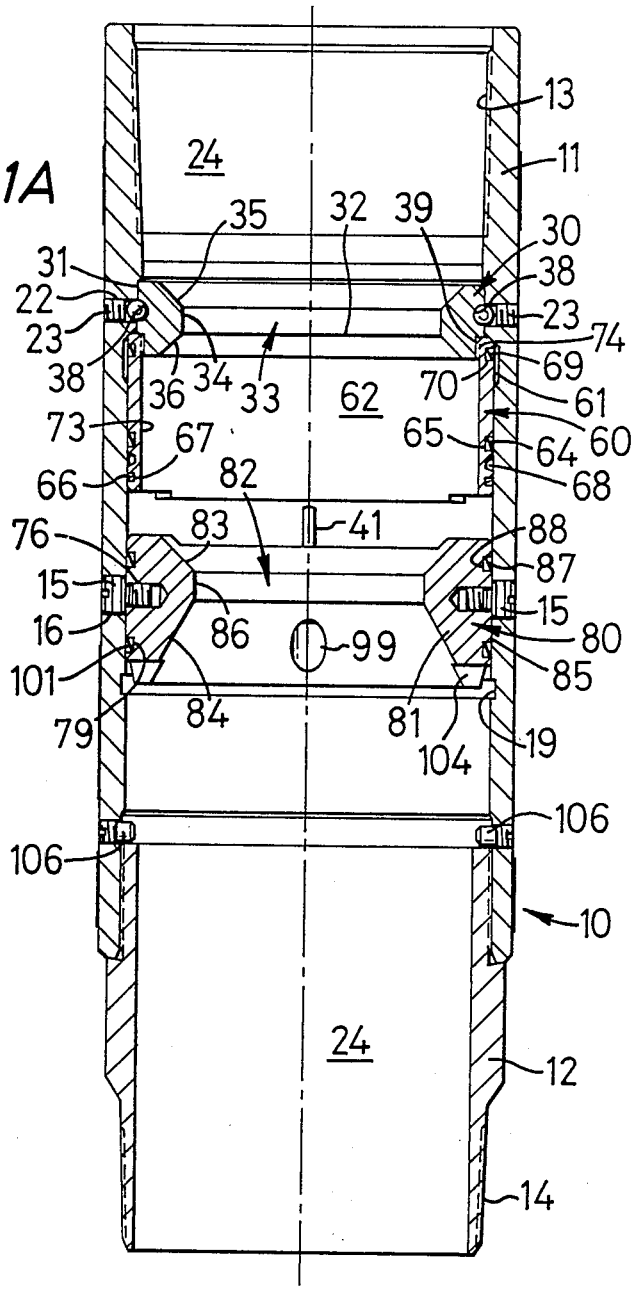
FIG. 1A is a longitudinal section of a tool according to this invention.
Figure 1B:
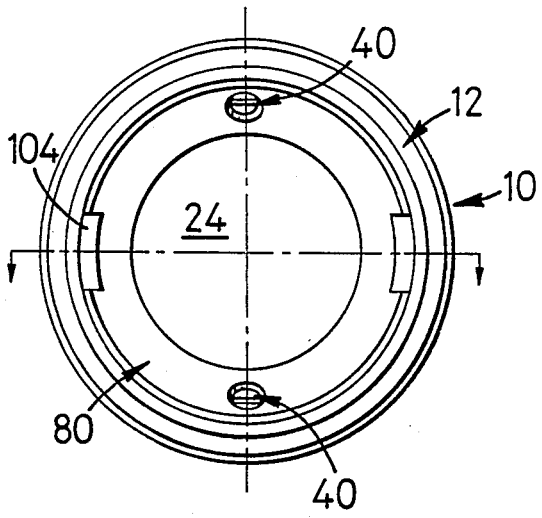
FIG. 1B is an end view of the tool of FIG. 1A.
Figure 1D:
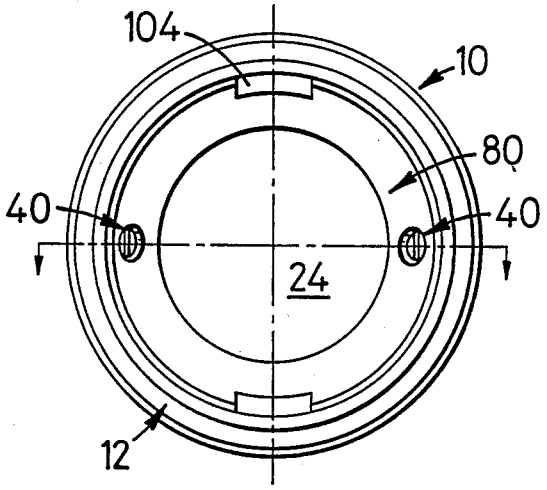
FIG. 1D is an end view of the tool of FIG. 1C.
Figure 1C:
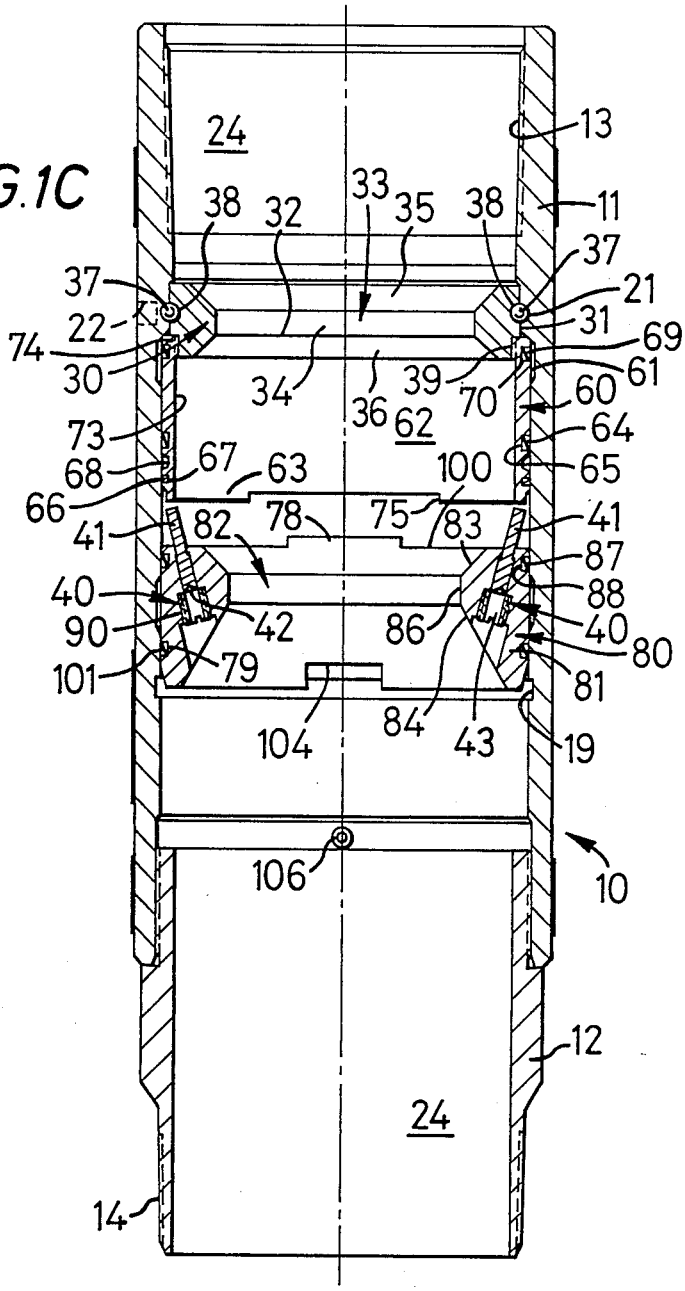
FIG. 1C is another longitudinal section of the tool of FIG. 1A.
Figure 1E:
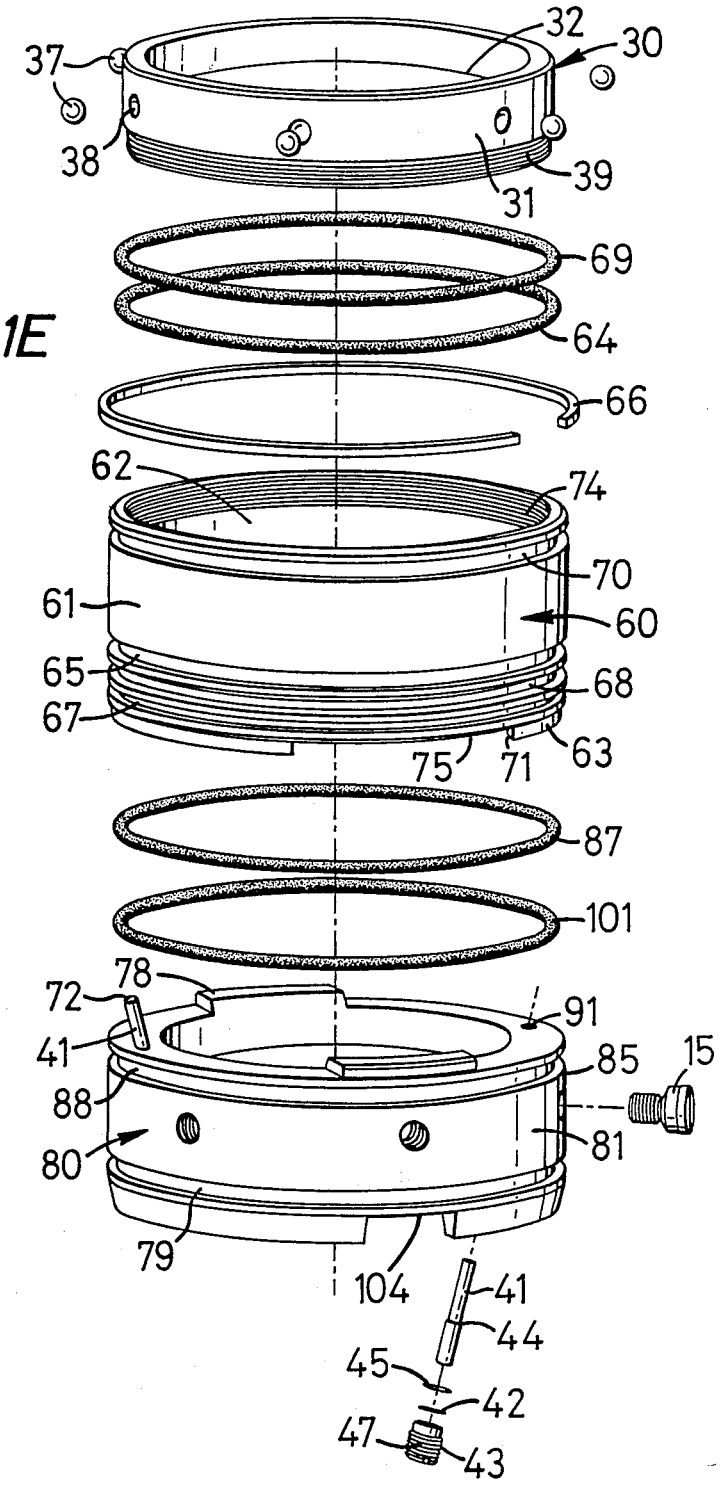
FIG. 1E is an exploded view of the tool of FIG. 1A.

For convenience in reviewing the drawings, the following legend is given:

| | | | |
|---|---|---|---|
| 10 | stage tool | 65 | recess on 61 for 64 |
| 11 | upper case | 66 | snap ring |
| 12 | lower case | 67 | recess on 61 for 66 |
| 13 | threads, upper | 68 | diffuser groove |
| 14 | threads, lower | 69 | seal |
| 15 | shear plugs | 70 | recess on 61 |
| 16 | cementing ports | 71 | lower lip of 60 |
| 17 | recess on 11 | 72 | pin 41 top |

-continued

| | |
|---|---|
| 18 | wellbore |
| 19 | recess on 11 |
| 20 | recess on 11 |
| 21 | recess on 11 |
| 22 | hole on 11 |
| 23 | plugs |
| 24 | bore of 10 |
| 25 | casing |
| 26 | casing |
| 27 | annulus |
| 28 | interior surface of 18 |
| 29 | portion of 16 |
| 30 | upper seat |
| 31 | exterior surface |
| 32 | interior surface |
| 33 | bore of 30 |
| 34 | cylindrical surface |
| 35 | ridge |
| 36 | ridge |
| 37 | shear balls |
| 38 | recesses for 37 |
| 39 | threads (w/74) |
| 40 | hydraulic lock alleviation device |
| 41 | puncture pin |
| 42 | puncturable disc |
| 43 | gland nut |
| 44 | step on pin 41 |
| 45 | seal |
| 46 | rim on 41 |
| 47 | threads on 97 |
| 48 | threads on 43 |
| 49 | interior bore of 43 |
| 50 | opening plug |
| 51 | plate of 50 |
| 60 | upper sleeve body |
| 61 | exterior of 60 |
| 62 | interior of 60 |
| 63 | downwardly extending member of 60 w/100 |
| 64 | seal |
| 210 | hydraulic lock alleviation device |
| 242 | rupturable disc |
| 243 | gland nut |
| 245 | seal |
| 247 | interior threads of 297 |
| 248 | threads on 243 |
| 249 | bore of 243 |
| 250 | space |
| 290 | stepped channel |
| 294 | shoulder of 290 |
| 297 | lower portion of 290 |
| 310 | hydraulic lock alleviation device |
| 311 | threaded portion |
| 312 | fracture point |
| 313 | recess in plug |
| 314 | end |
| 315 | groove of 320 |
| 316 | seal |
| 317 | edge |
| 318 | thread relief recess |
| 319 | side |
| 320 | knock-off plug |
| 321 | bore of plug |
| 390 | channel |
| 393 | shoulder of 390 |
| 397 | threads of 390 |
| 410 | hydraulic lock alleviation device |
| 420 | valve spool |
| 421 | groove |
| 422 | seal |
| 423 | hole for 430 |
| 424 | hole for 431 |
| 425 | edge |
| 427 | end |
| 73 | bore in 60 |
| 74 | threads (w/39) |
| 75 | recesses in 60 w/78 |
| 76 | recesses in 80 |
| 78 | shoulders on 80 w/75 |
| 79 | recess in 85 for 101 |
| 80 | lower sleeve |
| 81 | body member |
| 82 | central circular opening |
| 83 | ridge of 80 |
| 84 | ridge of 80 |
| 85 | exterior surface |
| 86 | interior cylindrical surface of 80 |
| 87 | O-ring seal |
| 88 | recess on 80 for 87 |
| 89 | groove |
| 90 | stepped channel |
| 91 | top opening |
| 92 | top shoulder |
| 93 | mid portion |
| 94 | mid shoulder |
| 95 | intermediate portion |
| 96 | intermediate shoulder |
| 97 | lower portion |
| 98 | lower shoulder |
| 99 | bottom opening |
| 100 | groove on 81 w/63 |
| 101 | seal |
| 102 | lip on lower sleeve |
| 103 | head of 15 |
| 104 | recesses |
| 105 | seal on 51 |
| 106 | anti rotation pins |
| 107 | closing plug |
| 108 | bore of |
| 109 | space in 11 |
| 110 | area between plugs |
| 112 | recompression angle |
| 113 | area |
| 114 | groove for 66 |
| 115 | space |
| 429 | shoulder |
| 430 | shear pin |
| 431 | shear pin |
| 440 | channel in 420 |
| 441 | a, b holes |
| 442 | recess |
| 481 | edge |
| 490 | channel in 80 |
| 510 | hydraulic lock alleviation device |
| 520 | solid spool |
| 527 | end |
| 531 | shear pin |
| 590 | channel in 80 |
| 610 | hydraulic lock alleviation device |
| 630 | lock member |
| 631 | edge of 636 |
| 632 | break off rod of 630 |
| 633 | hole in 630 for 640 |
| 634 | side of 638 |
| 635 | lower arm of 630 |
| 636 | extension of 630 |
| 637 | side of 632 |
| 638 | upper extension of 635 |
| 639 | corner of 632 |
| 640 | pivot pin |
| 641 | shaft of 640 |
| 642 | head of 640 |
| 650 | valve spool |
| 651 | side of 650 |
| 652 | groove of 651 for 653 |
| 653 | seal |
| 654 | groove in 650 |
| 655 | side of 654 |
| 681 | recess |
| 682 | side of 681 |
| 683 | side of 681 |
| 684 | hole in 80 |
| 690 | channel through 80 |

-continued

| | |
|---|---|
| 428 | surface of 420 |

DESCRIPTION OF PREFERRED EMBODIMENTS

Referring now to FIGS. 1A–1E and 2, a stage tool 10 is shown with a hydraulic lock alleviation device 40. The stage tool 10 has an outer case including an upper case 11 and a lower case 12 which is shown as threadly connected to the upper case 11, but which may be welded or otherwise secured. Threads 13 are provided on the upper case and threads 14 are provided on the lower case for mating with standard connections on casing or other tubulars. Preferably the cases are made from a grade of steel compatible with typical casing.

Within the cases 11, 12 are disposed an upper seat 30, an upper sleeve 60, and a lower sleeve 80. With appropriate action each of these items can be moved within the case 13. Shear plugs 15 are partially disposed in a tight sliding fit in cementing ports 16. These plugs prevent the flow of cementing fluid to the exterior of the tool 10 until the lower sleeve 80 has been moved downwardly to shear the plugs 15 thereby opening the ports (as will be described in detail below).

The lower sleeve 80 has a generally circular lower sleeve body member 81 with recesses 76 for threadedly receiving and holding a threaded portion of the shear plugs 15. The body member 81 has a central circular opening 82 with an interior cylindrical surface 86 at the termination of ridges 83 and 84 which extend inwardly from the exterior surface 85 of the body member 81. An O-ring seal 87 is disposed in recess 88 in the exterior surface 85 of the body member 81. An O-ring seal 101 is disposed in recess 79 in the exterior surface 85 of the body member 81. A stepped channel 90 at an angle of 15° to the longitudinal axis of the lower sleeve 80 is provided in and through the body member 81.

As shown in FIG,. 2, the stepped channel 90 has a top opening 91, a top shoulder 92, a mid portion 93, a mid shoulder 94, an intermediate portion 95, an intermediate shoulder 96, a threaded lower portion 97, a lower shoulder 98, and a bottom opening 99. A groove 89 on the bottom of the body member 81 is provided for anti-rotational locking of the body member 81 onto anti-rotation pins 106. A groove 100 on the top of the body member 81 is provided for anti-rotational locking with a downwardly extending member 63 of the upper sleeve body 60; conversely shoulders 78 on the lower sleeve 80 extend into recesses on the sleeve 60 to prevent rotation. Although the channel 90 may be at any angle so long as flow through the body 81 is permitted and other parts do not restrict flow through the tool 10, it is preferred that the channel be at an angle of 15° tilted away from the tool's longitudinal axis as indicated for alignment between the top 72 of the puncture pin 41 and an angled lower lip 71 on the upper sleeve body 60.

The recess 17 in the interior wall of the case 12 is provided for clearance for the seals 87 and 64 as they move past the ports 16 upon downward movement of the lower sleeve 80. The recess 19 in the interior wall of the case 12 is provided for receiving a lock ring 66 for holding the upper sleeve 60 in locked position. The seals 101 and 87 assist in sealing off flow to port 16.

The hydraulic lock alleviation device (including the stepped channel 90) includes a puncture pin 41, a puncturable disc 42, a seal 45, and a gland nut 43 disposed in the lower portion 97 of the stepped channel 90. It is preferred that the puncture pin 41 be made from a drillable material such as brass or aluminum. The pin 41 has a step 44 which abuts the shoulder 92 to prevent the pin 41 from falling out inadvertently through the top opening 91. A seal 45 abuts the shoulder 94 and the puncturable disc 42 abuts the seal 45. The disc 42 effectively seals off the channel 90 to the flow of fluid therethrough and the disc is fabricated to withstand a certain amount of pressure and to be rupturable in response to a certain amount of pressure. The pin 41 can have a pointed rim 46 to assist in puncturing the disc 42. The lower portion 97 of the channel 90 has interior threads 47 which can mate with threads 48 on the gland nut 43. The gland nut 43 retains the disc 42 and the seal 45 in position. The gland nut 43 has an interior bore 49 which can receive the pin 41 and through which the pin 41 can pass.

Figure 2:
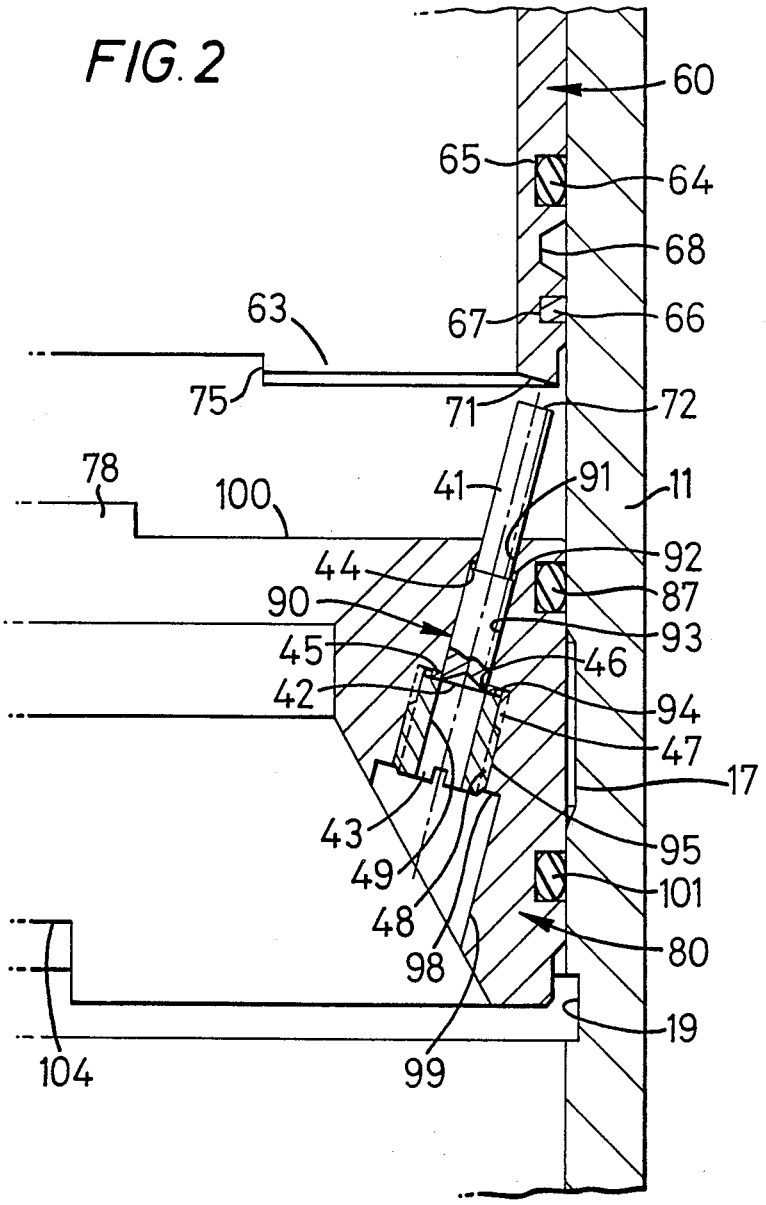
FIG. 2 is an enlarged view of a portion of the tool of FIG. 1A.

The hollow upper sleeve body 60 (preferably made from steel) is generally circular and has an exterior surface 61 , an interior surface 62, a generally circular bore 73, and a downwardly extending member 63. The member 63 is disposable in groove 100 of the lower sleeve 80 for antirotation locking. O-ring seal 64 is disposed in a recess 65 in the exterior surface 61. O-ring seal 69 is disposed in recess 70 in the exterior surface 61. A snap ring 66 is disposed in recess 67 in the exterior surface 61. A diffuser groove 68 formed in the exterior surface 61 interrupts or diffuses the flow of fluid flowing to the ports 16 which, if uninterrupted, could damage the seal 64. The upper sleeve body 60 has a lower lip 71 which, as shown in FIG. 2, can be configured at an angle to meet flush and parallel with a top 72 of the pin 41 for more accurate pushing on the pin 41.

The upper seat 30 has an exterior surface 31, an interior surface 32, a generally circular bore 33, and an interior cylindrical surface 34 at the termination of ridges 35 and 36. The lower portion of the upper seat 30 is threadedly connected in the top of the upper sleeve body 60 by means of threads 39 on the upper seat 30 and threads 74 on the upper sleeve 60. Closing shear balls 37 rest in and are partially disposed in recesses 38 in the exterior surface 31. The shear balls 37 are also partially disposed in and held by recesses 21 in the case 11. The balls are initially inserted by lining up a recess 38 with the hole 22, dropping a ball into a recess. The upper seat 30 is then rotated until another recess 38 appears under the hole and another ball 37 is inserted. The balls 37 move in a recess 21 in the interior surface of the case 11. After the balls are inserted, a plug 23 is placed in the hole 22 to seal it. The balls 37 are fabricated so that they will shear at a desired pressure releasing the upper seat 30.

Figure 3A:
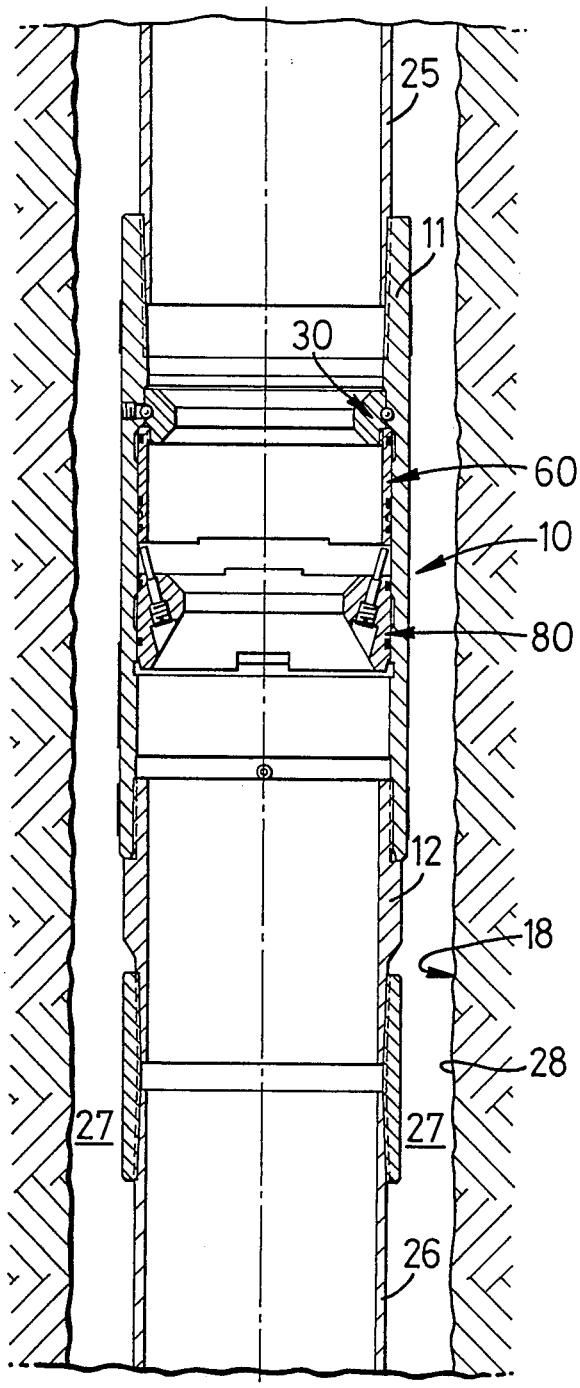
FIG. 3A is a view of the tool of FIG. 1A in a wellbore.
Figure 3B:
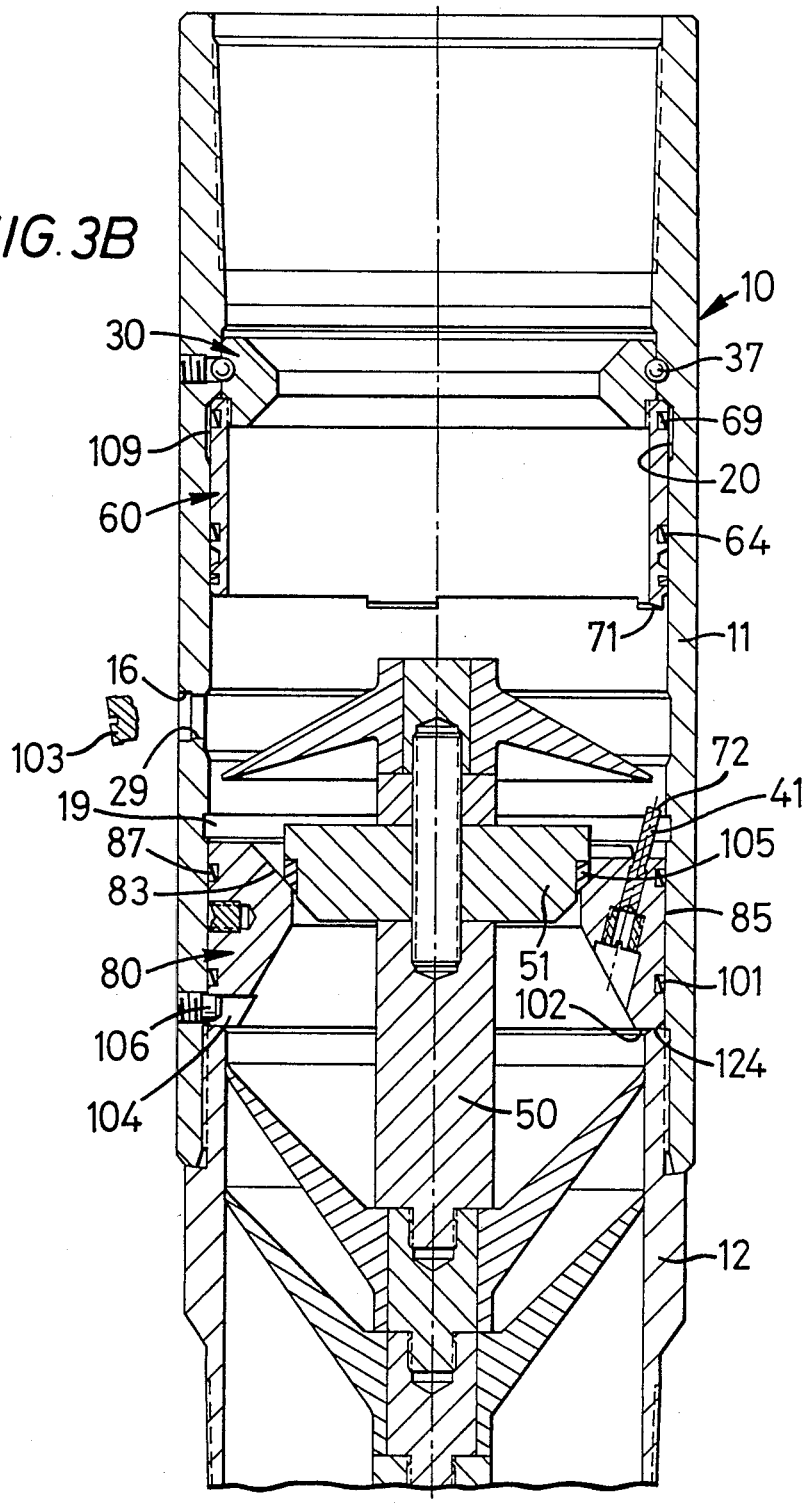
FIG. 3B is a view of the tool of FIG. 1A with an opening plug in it.
Figure 4:
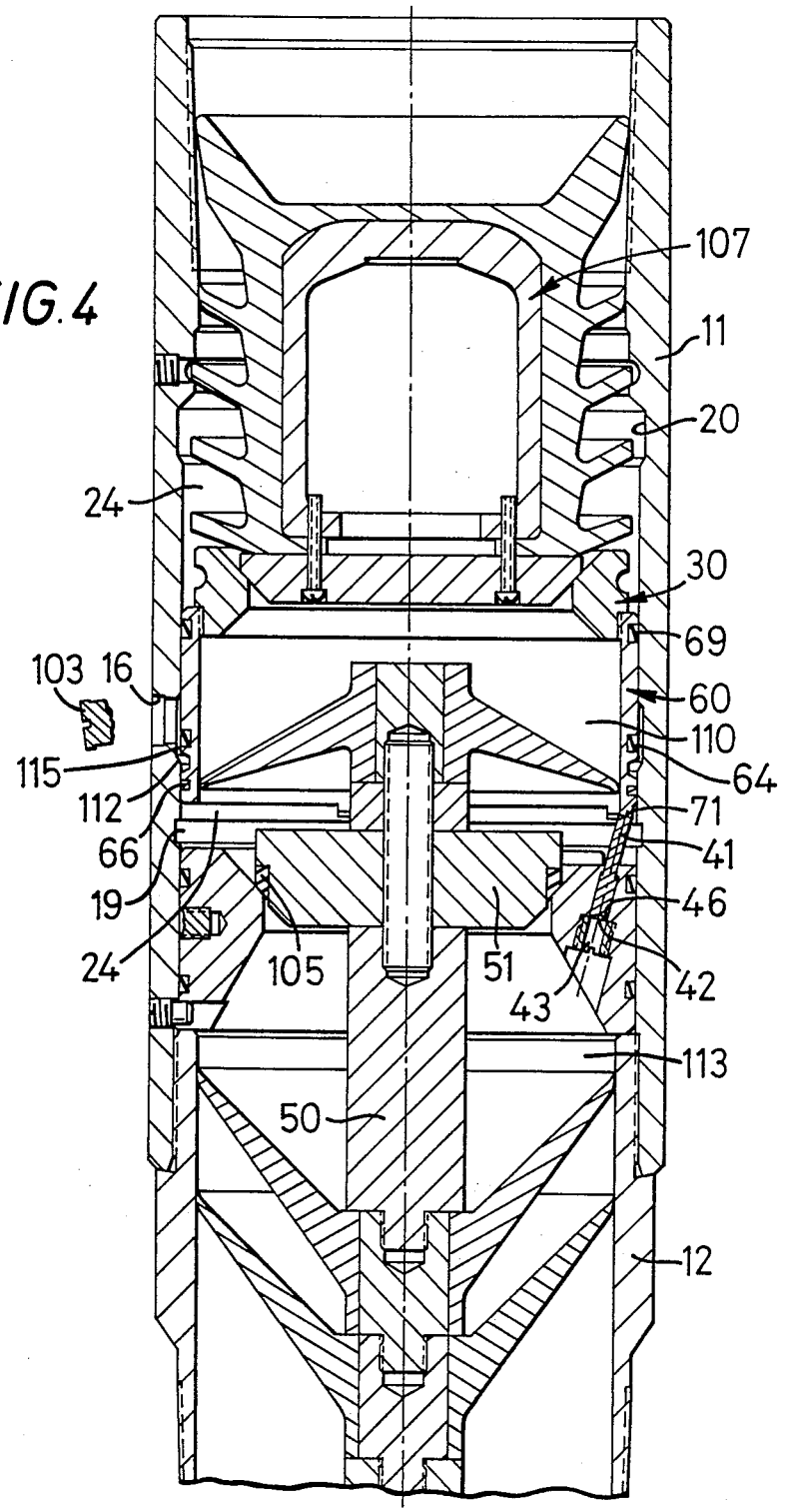
FIG. 4 is a view of the tool as shown in FIG. 3 with a closing plug.
Figure 5:
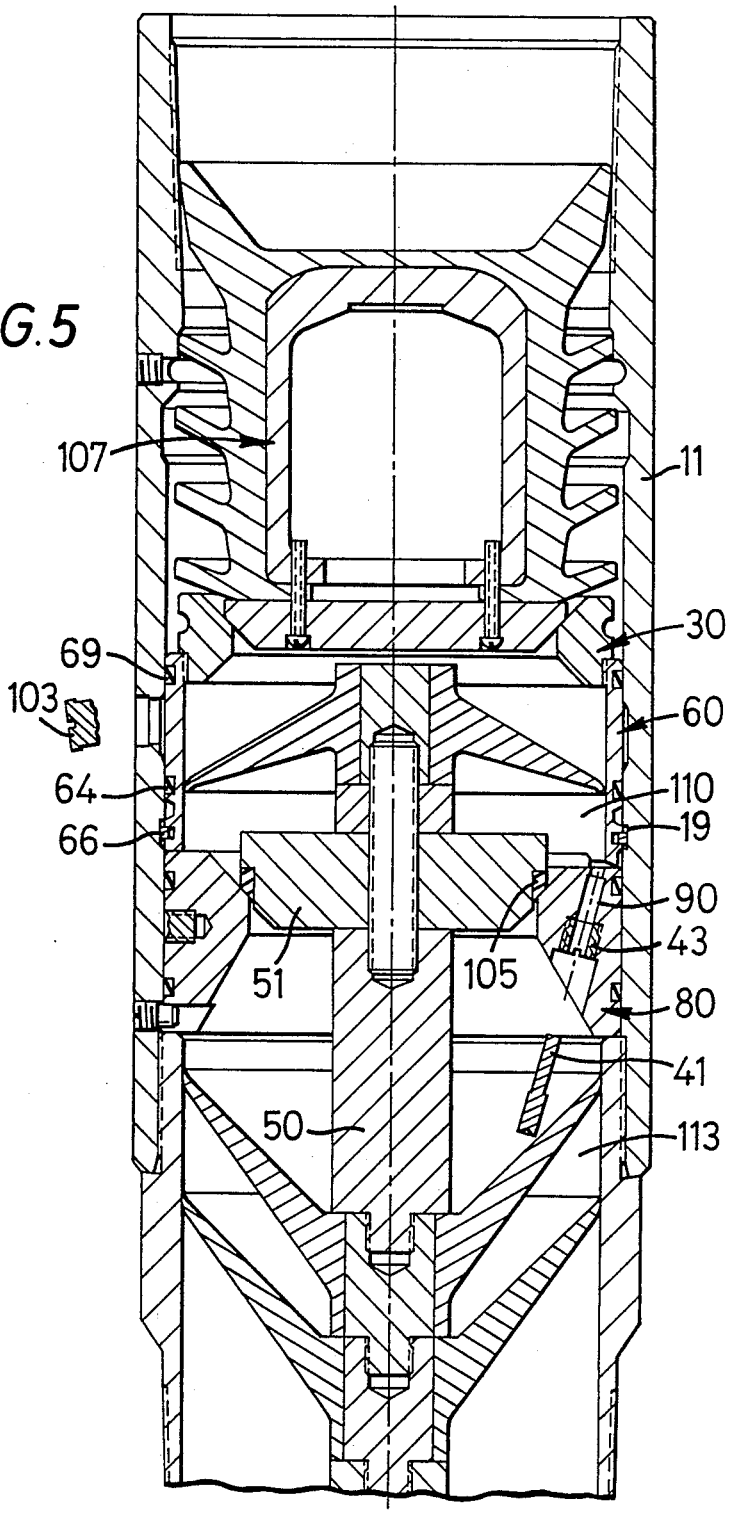
FIG. 5 is a view of the tool shown in FIG. 4 with the plugs in closer proximity.

FIGS. 3B, 4, and 5 illustrate various stages in the operation of a tool according to this invention such as the tool 10 shown in between two casings 25, 26 in a wellbore 18 in FIG. 3A. As shown in FIG. 3 an opening plug 50 has been inserted into the tool 10 which is emplaced in a wellbore (not shown). A plate 51 of the plug 50 has contacted the ridge 83 of the lower sleeve 80 and pushed the lower sleeve 80 downwardly with force sufficient to break the shear plugs 15, thereby freeing the lower sleeve 80 so that it can move downwardly to a point where its motion is stopped by the abutment of a lip 102 of the lower sleeve against a shoulder 24 of the lower case 12. Rotation of the lower sleeve 80 is prevented by antirotation pins 106 which are received in and held by recesses 104 in the exterior surface 85 of the lower sleeve 80.

Once the shear plugs 15 are broken and the sleeve 80 moves, the ports 16 are open to the flow of cementing fluid from the interior of the tool 10 to the annulus 27 (FIG. 3A) between the wellbore's interior surface 28 and the tool's exterior. A seal 105 on the plate 51 helps the plate 51 to seal against the ridge 83 so that cementing fluid is prohibited from flowing downwardly beyond the plate 51. As shown in FIG. 3 a head 103 of the broken shear plug 15 has fallen out of and away from the port 16. Because the head 103 is larger in diameter than a portion 29 of the port 16, the head 103 cannot fall into the tool 10.

With the cement ports 16 open, circulation may be established to prepare the wellbore annulus for cementing or cementing through the port 16 may begin immediately. As cementing progresses to the final stages, a considerable hydrostatic pressure differential is realized across the lower sleeve 80 and the opening plug 50 due to a relative increase in density of the cement column in the annulus 27 with respect to the static displacement fluid in the area below the plug 50. This pressure differential is prevented from equalizing with the pressure below the plug 50 by: the bridge and seal of the plug 50 in the sleeve 80; the gland nut 43, the disc 42 and the seal 45 arrangement in the sleeve 80; and the seals 101 and 87 in the sleeve 80. The disc 42 is designed to sustain extremely high pressures that would not even be expected in cementing, and these pressures have no effect on the pin 41 to cause premature activation of the volume relief mechanism.

Referring now to FIGS. 3 and 4, a closing plug 107 displaces final quantities of cement slurry through the ports 16, the plug 107 has landed on the seat 30 and a pressure tight bridge has been formed across the bore 24. As surface casing pressure increases, a sufficient downward force is imparted to the shear balls 37 to break them and allow the upper sleeve 60 and the upper seat 30 to shift downward. At this moment, a recess 20 in the interior surface of the case 11, under the seal 69 in FIG. 3, has equalized pressure in the small space 109 (between the seals 69, 64, the sleeve 60 and the case 12) with cement slurry pump pressure in the area 110 between the two plugs. This pressure equalization prevents the seal 64 from being pressure energized in to the port 16 and cut as the sleeve 60 slides past the port.

When the lip 71 slides past the recompression angle 112, cement slurry inside the area 110 begins to create high velocity jets in space 115 as it exits through the space 115 between the sleeve 60, the snap ring 66 and the bore 24 in proximity to the ports 16. These jets of fluid are extremely small in volumetric flow rate as compared to the volumetric flow rates of the ports 16. This decrease in volumetric flow rate and the incompressible nature of the cement slurry imparts a braking force to the upper sleeve 60 causing it to slow down in its remaining travel as fluid slowly meters out of the space 115 through the port 16. The high velocity flow of these fluid jets close to ports 16 would impart a sudden pressure differential that would lift the seal 64 out of the recess 65 and into the port 16 and cut it as the sleeve 60 slides close. A diffuser groove 68 in the sleeve 60 causes a more even flow pattern around the circumference of the sleeve 60 that disrupts the lifting force and prevents or inhibits seal damage.

As entrapped fluid continues to flow slowly from area 110 into space 115 and then to port 16, the upper sleeve 60 slowly moves into position as shown in FIG. 4. The lip 71 of the upper sleeve 60 comes into contact with the end of the pin 41. Downward force that is continuously being applied to the upper sleeve 60 by the upper seat 30 through the plug 107 from surface casing pressure above the plug is now imparted to the puncture pin 41. The pointed rim 46 of the lower end of the pin 41 is driven through the disc 42 as it is held in place by the gland nut 43. This action takes place before the seal 64 reaches recompression angle 112 to seal off the ports 16. Further movement of the upper sleeve 60 drives the pin 41 into the gland nut interior bore 49. As the seal 64 reaches the recompression angle 112, a hydraulic lock will be effected and inhibit or freeze any further travel of the upper sleeve 60 until entrapped fluid in the area 110 helps to push the pin 41 out of the bore 90 and into the area 113. As the pin 41 enters the area 113, cement slurry from the area 110 may flow freely into the area 113 to relieve the hydraulic lock and allow the upper sleeve 60 to travel to the position shown in FIG. 5.

As the entrapped fluid exits through the channel 90 of the lower sleeve 80, the sleeve 60 travels downward until it abuts the lower sleeve 80. The snap ring 66 is now adjacent the groove 114 in the upper case 11 and springs outwardly, since it is biased as such, to permanently lock the upper sleeve 60 in place. The seals 64 and 69 are positioned across ports 16 to effect a pressure tight seal.

Closing the ports 16 completes the cementation process of this stage. Other stages may be cemented or the drill out of the plugs 50 and 107 and the seats 30 and 80 may be performed. This device according to the present invention is a significant improvement over apparatuses as disclosed in U.S. Pat. Nos. 3,811,500 and 3,842,905. The devices in these patents use a single shear device to secure a release rod in place. This single shear device must withstand loads placed on it by cementing pressures pushing on the rod, so it must have a relatively high resistance to shear to prevent premature activation. But this same shear device must also shear when desired to release the rod and hence high shear resistance is not desirable; i.e., the easier it can be for the shear device to shear and release the rod, then the easier it is to design the shear device and have the rod-release action accomplished correctly. In our device there is a rupturable disc which can withstand the high cementing pressures, but which also has a puncture pin which is movable by a relatively small force from the lower sleeve. The puncture-pin mode does not disrupt sleeve travel or tool operation. So there is the protection or desired aspects of resistance to high pressure via the disc, but also the ability to release the trapped fluid in response to a relatively low force on the puncture pin. This same concept is present in the knock-off plug, crush plug, a spool-with-separate-locking-and-releasing-means embodiments described below.

Placing the hydraulic lock alleviation apparatus in the lower sleeve and related methods have proven to be most reliable (i.e. puncture pin 41, disc 42); however, other methods can be applied within the scope of the present invention, including, e.g., ceramic crush plugs; rupturable discs; plastic knock-off plugs; and a valve spool with a lock released by an upper sleeve.

Figure 6:
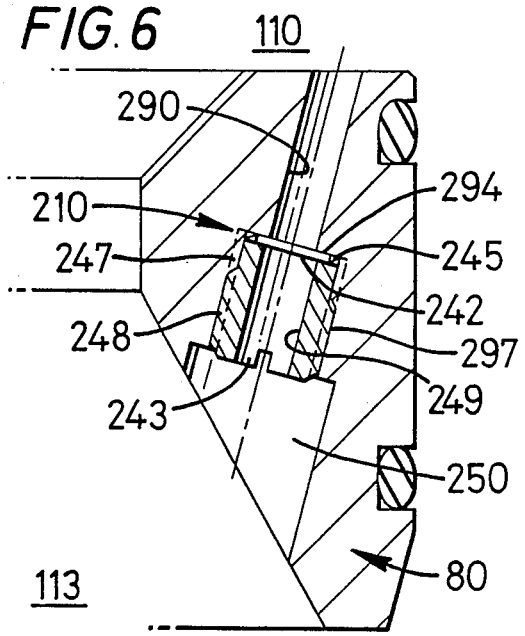
FIG. 6 is a crossectional view of an hydraulic lock alleviation device according to this invention.

A hydraulic lock alleviation device 210 shown in FIG. 6 as disposed in the lower sleeve 80 of FIG. 2 in place of the device 40 includes a rupturable disc 242, a seal 245, a stepped channel 290, and a gland nut 243 disposed in stepped channel 290. An O-ring seal 245 abuts the shoulder 294 and the rupturable disc 242 abuts the seal 245. The disc 242 effectively seals off channel 290 to the flow of fluid therethrough, and the disc is fabricated to withstand a certain amount of pressure and to be rupturable at a certain amount of pressure. The lower portions 297 of the channel 290 has interior threads 247 which can mate with threads 248 on gland nut 243. The gland nut 243 retains the disc 242 and the seal 245 in position. The gland nut 243 has an interior bore 249 through which fluid may flow. A pressure increase in the space above the device 210 will be transmitted through the channel 290 to the disc 242 until the rupture pressure of the disc is reached; thereby rupturing the disc and allowing fluid to flow from above the device, through the channel 290 and into a second space 250 below the device. As this occurs, an upper sleeve such as sleeve 60 in FIG. 2 will be permitted to move to abut the lower sleeve 80 and any hydraulic lock will be relieved.

A hydraulic lock alleviation device 310 as shown in FIGS. *7a, 7b,* and *7c* includes a channel 390 and a knock-off plug 320. It is preferred the knock-off plug 320 be made from plastic so that the plug may break in the proper manner as described below. The plug 320 has a threaded portion 311 which can mate with threads 397 of channel 390. A groove 315 of the plug 320 receives a seal 316 that abuts with a shoulder 393 of the channel 390 to effectively seal off the channel 390 to the flow of fluid therethrough. The plug 320 is secured in place by the threads 311 and is designed to sustain extremely high pressures that would not even be expected in cementing operations. The plug 320 has a recess 313 that extends into an edge 317 past the groove 315 but not through an end 314. A thread relief recess 318 has a fracture point 312 that is made to break if sufficient force is put on end 314 or side 319. The device 310 can be disposed, for example, in a lower sleeve such as the sleeve 80 (FIG. 2) in place of device 40. With this structure, before the seal 64 hits the recompression angle 112, the lip 71 of the upper sleeve 60 comes into contact with the end 314 o±the knock-off plug 320. Downward force that is continuously being applied to the upper sleeve 60 by the upper seat 30 through the plug 107 is now applied to the plug 320. The plug 320 breaks at the fracture point 312 as the plug is forced down and channel 390 is open to area 110 through bore 321 through the plug. Cement slurry from area 110 may flow freely into area 113 to prevent a hydraulic lock, and upper sleeve 60 may travel until it hits lower sleeve 80. The plug 320 may be a crushable plug made from a suitable crushable material (e.g. ceramics or glass) which instead of being forced down is crushed or shattered.

Figure 8A:
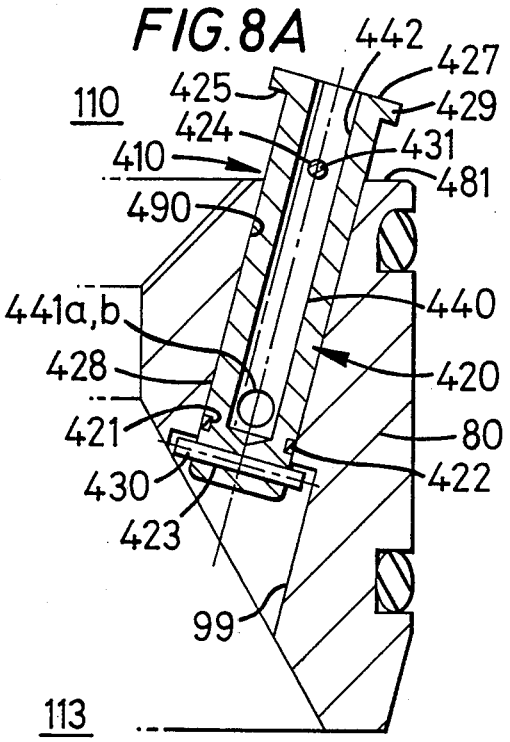
FIGS. 8A and 8B are crossectional views of a device according to this invention.
Figure 8B:
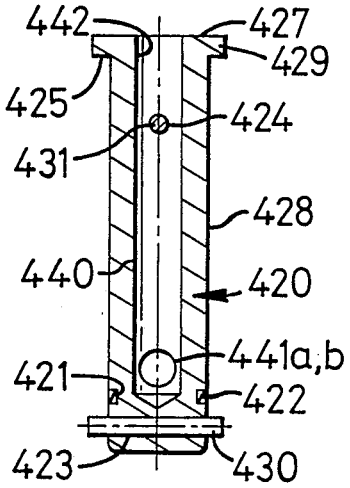
Figure 7A:
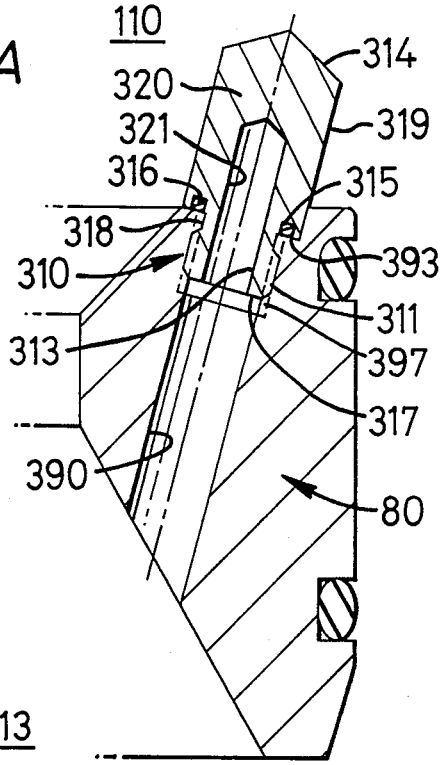
FIGS. 7A, 7B, and 7C are crossectional views of a device according to this invention.
Figure 7B:
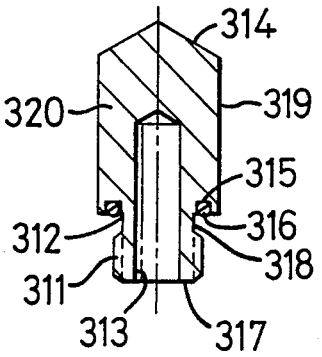
Figure 7C:
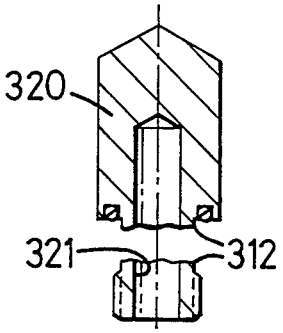

A hydraulic lock alleviation device 410 as shown in FIGS. 8A and 8B includes a channel 490, a valve spool 420, shear pins 430 and a seal 422. It is preferred that the spool 420 be made from a drillable material such as brass or aluminum. The spool 420 has a groove 421 in a surface 428 that accepts the seal 422. The spool 420 has shear pins 431 and 430 pressed into holes 424 and 423, respectively, to prevent the spool 420 from inadvertently falling out or shearing out of sleeve 80 under cement pressures. The spool effectively seals off the channel 490 to the flow of fluid therethrough and the pins 431 and 430 are made to withstand a certain amount of shear force to hold the spool 420 in place. The spool 420 has a channel 440 that consists of a recess 442 and holes 441*a, b.* The recess 442 in an end 427 extends axially into the spool 420 until it intersects the holes 441 *a, b.* The holes 441 *a, b* are in close proximity to the groove 421 on the opposite side of groove 421 as the hole 423. The device 410 can be disposed in a sleeve of a stage tool such as the sleeve 80 of the tool of FIG. 2. With this structure, before the seal 64 hits the recompression angle 112, the lip 71 of the upper sleeve 60 comes into contact with the end 427 of spool 420. Downward force applied to the spool 420 breaks the pin 431. Further movement of the upper sleeve 60 abuts an edge 425 of a shoulder 429 onto an edge 481 of sleeve 80 and causes the holes 441 *a, b* to travel into the bottom opening 99. Cement slurry now flows freely from area 110 to area 113 to prevent a hydraulic lock from occurring. The sleeve 60 may travel uninterrupted until abutting with the sleeve 80.

Figure 9A:
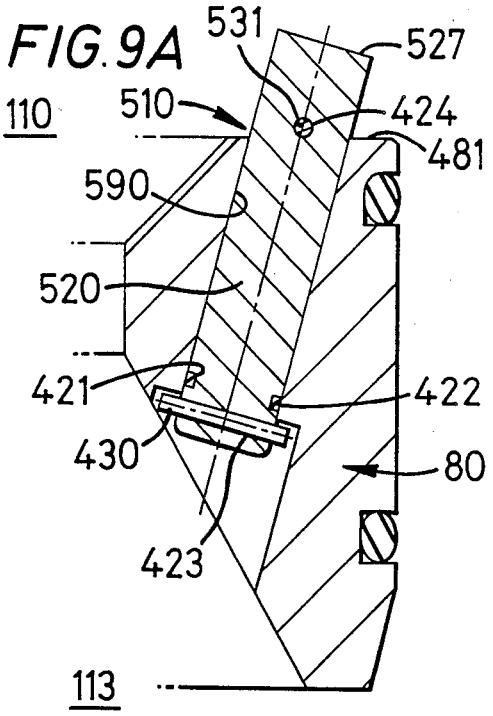
FIGS. 9A and 9B are crossectional views of a device according to this invention.
Figure 9B:
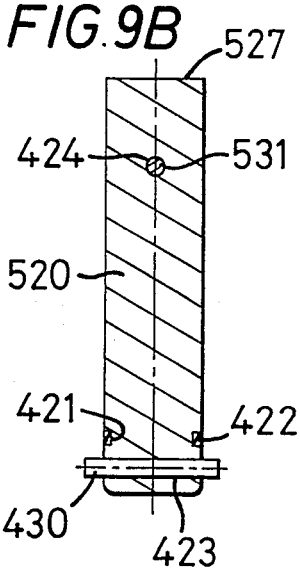

The device 510 shown in FIGS. 9A and 9B is like device 410 but a spool 520 is solid and has no shoulder like shoulder 429, no end 425 and no channel through it. The device 510 can be disposed in a sleeve 80 as in FIG. 2 in place of the device 40. With this structure before the seal 64 hits recompression angle 112, the lip 71 of the upper sleeve 60 comes into contact with an end 527 of spool 520. Downward force is now imparted to the spool 520 to break a pin 531. Further movement of the sleeve 60 causes the seal 64 to hit the recompression angle 112, a hydraulic lock will be effected and inhibit or freeze any further travel of the sleeve 60 until entrapped fluid in area 110 helps to push the spool 520 out of channel 590 in sleeve 80 and into the area 113. As the spool 520 enters area 113, cement slurry from the area 110 may flow freely into the area 113 to relieve the hydraulic lock.

Figure 10:
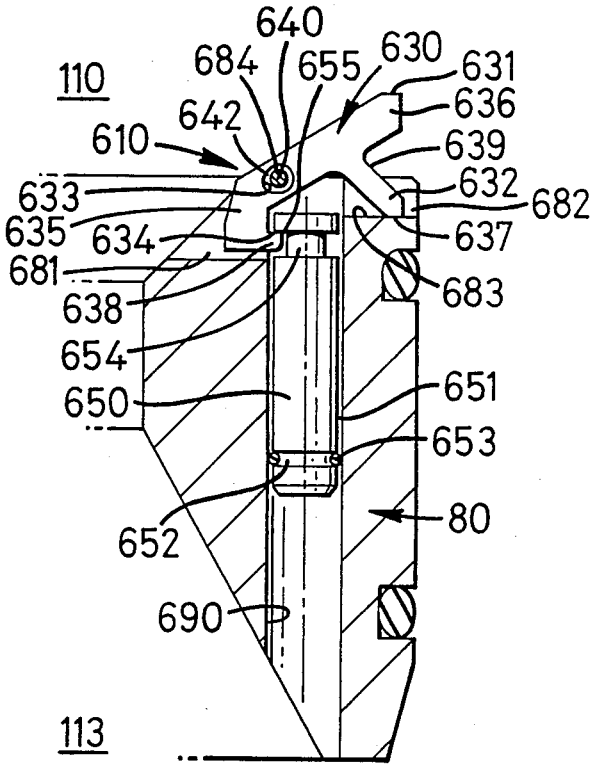
FIG. 10 is a crossectional view of a device according to this invention.

An hydraulic lock alleviation device 610 as shown in FIG. 10 includes a valve spool 650, a seal 653, and a lock member 630. It is preferred that the valve spool 650, the lock member 630 and a pivot pin 640 be made from a drillable material such as aluminum or brass. The lock member 630 has a hole 633 into which the pivot pin 640 slides. This device 610 may be used in place of device 40 in sleeve 80 of FIG. 2. The sleeve 80 has a hole 684 in side 682 of recess 681 into which a shaft 641 of the pivot pin 640 is pressed. The pivot pin 640 has an upset or head 642 that cannot pass through hole 633 of member 630. Therefore, member 630 is free to rotate on the pivot pin 640, and is captured on the shaft 641 by the head 642 on one side and by the side 682 of sleeve 80 on another. The spool 650 has a groove 654 in a side 651 that accepts an upper extension 638 of a lower arm 635 of the member 630. A groove 652 on the side 651 accepts the seal 653. The valve spool 650 effectively seals off the channel 690 to the flow of fluid therethrough and the upper extension 638 is designed to withstand a certain amount of shear force to withstand a certain amount of cement pressure that pushes the spool 650 until the side 655 of the recess 654 hits a side 634 of the upper extension 638. The member 630 with the pin 640 is designed in proximity to the spool 650 such that no rotational motion is imparted to member 630 by the spool 650 from cement pressures in the area above it which would prematurely release it.

The member 630 has break-off rod 632 whose side 637 abuts with a side 683 of a recess 681 of the sleeve 80 to prevent any clockwise rotation of member 630. The break-off rod 632 is designed to break at a fracture point at corner 639 at a certain amount of force. It can be fashioned to break in response to fluid pressure or in response to a member pushing down on it. Once broken at corner 639, member 630 may rotate to let the upper extension 638 retract from groove 654. With the device 610 in the sleeve 80 of the structure of FIG. 2, before the seal 64 hits the recompression angle 112, the lip 71 of the sleeve 60 hits the edge 631 of an extension 636 of the member 630. Downward force is now imparted to the member 630. The corner 639 is broken as the edge 637 is forced against edge 683 to impart breading stresses to corner 639. Break-off rod 632 is broken off of member 630 and allows member 630 to rotate around pin 640 to retract extension 638 from groove 654. As the seal 64 reaches the recompression angle 112, a hydraulic lock will be effected and inhibit or freeze any further travel of the sleeve 60 until entrapped fluid in the area 110 helps to push the spool 650 out of bore 690 and into area 113. As the spool 650 enters area 113, the cement slurry from area 110 may flow freely into the area 113 to relieve the hydraulic lock and allow the sleeve 60 to travel untill it abuts with sleeve 80.

As will be apparent to ordinarily skilled artisans, there are many tool configurations and methods which can utilize this invention and the invention is equally applicable to such tools and methods. Skilled artisans could conduct minor routine experimentation to determine precisely the best combination of the aspects described herein and yet still be within the scope of this invention. While there have been described various embodiments of the present invention, the methods and apparatus described are not intended to be understood as limiting the scope of the invention. It is realized that changes therein are possible and it is further intended that each step or element recited in any of the following claims is to be understood as referring to all equivalent steps or elements for accomplishing substantially the same results in substantially the same or equivalent manner. It is intended to cover the invention broadly in whatever form its principles may be utilized.

What is claimed is:

1. An hydraulic lock alleviation apparatus for disposition adjacent a first space in a wellbore in which an hydraulic lock can be created and a second space into which fluid trapped in the first space may be communicated by the hydraulic lock alleviation apparatus, the apparatus comprising a body member, the body member having a central bore therethrough permitting fluid communication between the first and second spaces, a channel through the body member in fluid communication with both the first space and the second space so that fluid communication is allowed between the two spaces through the channel, a pressure responsive member sealingly disposed in the channel to prevent the flow of fluid through the channel from the first space into the second space, wherein upon closure of the central bore to the flow of fluid therethrough thereby trapping fluid in the first space, the trapped fluid acts on the pressure responsive member to permit flow of the trapped fluid through the channel from the first space into the second space, thereby alleviating the formation of an hydraulic lock by the trapped fluid in the first space.

2. The apparatus of claim 1 wherein the pressure responsive member is a puncturable sealing disc disposed across and closing off the channel and the apparatus includes a puncture pin disposed in the channel and movable to puncture the pressure responsive member thereby permitting fluid to flow from the first space into the second space.

3. The apparatus of claim 2 wherein the puncture pin is configured so that it passes through the pressure responsive member once it has been punctured and exits from the channel.

4. The apparatus of claim 1 wherein a seal member is disposed in contact with the pressure responsive member and between the pressure responsive member and the channel to provide a seal between the pressure responsive member and the channel, the channel being in fluid communication with the two spaces.

5. The apparatus of claim 1 wherein a gland nut with a bore therethrough is disposed in the channel to hold the sealing disc in place in the channel, the channel in communication with the bore of the gland nut so that the fluid is able to flow through the bore in the gland nut and into the second space upon rupturing of the sealing disc.

6. The apparatus of claim 2 including a gland nut with a central bore communicable with the channel, the gland nut disposed in the channel to hold the disc in place, the puncture pin configured for passage through the gland nut bore after puncturing the disc.

7. The apparatus of claim 1 wherein the pressure responsive member is a rupturable sealing disc disposed across and closing off the channel.

8. The apparatus of claim 1 wherein the pressure responsive member is a breakable plug disposed partially in the channel and partially disposed in the first space, the breakable plug having an interior bore extending through the part of the plug disposed in the channel and communicating with the channel and extending into the part of the plug disposed in the first space, the bore not in communication with the first space, and the plug breakable so its interior bore provided communication between the channel and the first space.

9. The apparatus of claim 1 wherein the pressure responsive member is a valve spool disposed in and movable in the channel, the valve spool held immobile in the channel by shear pin means extending from within the body to within the valve spool, the spool movable upon shearing of the shear pin means in response to the pressure of fluid in the first space, the spool movable to permit the flow of fluid from the first space through the channel.

10. The apparatus of claim 9 wherein the spool has a shoulder for preventing it from falling out of the channel into the second space.

11. The apparatus of claim 10 wherein the spool has a spool bore in communication with the first space and hole in the spool in communication with the spool bore the spool movable in the channel so that the holes can be moved into communication with the channel so that fluid can flow from the first space, through the spool bore through the holes, into the channel, and then into the second space.

12. The apparatus of claim 9 wherein the valve spool is configured to be passable through and out of the channel upon shearing of the shear pin means.

13. The apparatus of claim 1 wherein the pressure responsive member comprises a valve spool movably disposed in the channel and closing it off to flow, a movable arm pivotably mounted to the body member above the spool, the arm having a finger extending into a recess on the spool, the spool movable upon release of the finger from the recess, the arm prevented from movement by an extension of the arm which abuts the body member holding the arm immobile and is breakable to permit movement of the arm, an extension breakable either in response to the pressure of fluid in the first space or by the force of a member urged against the arm.

14. An hydraulic lock alleviation apparatus for disposition adjacent a first space in a wellbore in which an hydraulic lock can be created and a second space into which fluid trapped in the first space may be communicated by the hydraulic lock alleviation apparatus, the apparatus comprising a body member, a channel through the body member in fluid communication with both the first space and the second space so that fluid communication is allowed between the two spaces through the channel, a pressure responsive sealing disc disposed across the channel to prevent the flow of fluid from the first space into the second space, the disc rupturable by a puncture pin so that it moves or ruptures to permit flow through the channel from the first space into the second space when the pressure of the fluid in the first space reaches a predetermined level, thereby alleviating the formation of an hydraulic lock in the first space, the puncture pin disposed in the channel and movable to puncture the disc, the pin configured so that it passes through the disc and exits from the channel, and a gland nut with a bore therethrough disposed in the channel abutting the disc and holding the disc sealingly in place across and closing off the channel, the channel in communication with the bore of the gland nut so that the fluid is able to flow through the bore of the gland nut and into the second space upon rupturing of the disc.

15. A stage tool for well cementing operations, the tool disposable between and connectible to pieces of casing in a string of casing within a wellbore, the tool comprising a hollow outer case with two ends, a top end and a bottom end, and with a case bore therethrough for communicating with bores of pieces of casing connected to the case's top end and bottom end, the case having cementing port means therethrough for permitting the flow of cementing fluid from the case bore through the cementing port to the exterior of the case, a hollow generally cylindrical lower sleeve secured in the case and blocking the cementing port means and preventing the flow of fluid therethrough, the lower sleeve movable in response to a predetermined amount of force to unblock the cementing port means, the lower sleeve having disposed therein and therethrough an hydraulic lock alleviation apparatus for alleviating a hydraulic lock between an upper sleeve and the lower sleeve, the apparatus comprising a body member, a channel through the body member in fluid communication with both the space between the upper and lower sleeves and a second space beneath the apparatus into which fluid trapped in the first space may flow, a pressure responsive member sealingly disposed in the channel to close it off, the pressure responsive member actuable to permit fluid trapped between the upper and lower sleeves to flow into the second space thereby alleviating any hydraulic lock, and the upper sleeve comprising a hollow generally cylindrical upper sleeve secured in the case above the lower sleeve, the upper sleeve movable in response to a predetermined amount of force to contact and move the lower sleeve and to block the cementing port means after cementing fluid has flowed through the port means.

16. The stage tool of claim 15 wherein the pressure responsive member is a sealing disc and the hydraulic lock alleviation apparatus includes a puncture pin disposed in the channel and movable to puncture the disc thereby permitting entrapped fluid between the two sleeves to flow into the second space.

17. The tool of claim 16 wherein the puncture pin is disposed so that it can be contacted and moved by a lower portion of the upper sleeve.

18. The tool of claim 16 wherein the second space includes space below the lower sleeve within the body member of the hydraulic lock alleviation apparatus.

19. The tool of claim 15 wherein the lower sleeve is secured in the body member by shear plug means which extends both into a recess in the lower sleeve and into the cementing port means, the shear plug means shearable upon movement of the lower sleeve to open the cementing port means.

20. The tool of claim 15 wherein the sleeves have seat means for receiving and holding plugs for moving the sleeves.

21. The tool of claim 15 wherein the puncture pin and channel are disposed at an angle from the longitudinal axis of the tool.

22. The tool of claim 21 wherein the angle is 15° and is inclined toward the body member.

23. The tool of claim 15 wherein seal means are provided on the upper sleeve for sealing between the upper sleeve's exterior surface an the body member's interior surface and a diffuser groove is formed around the upper sleeve so that when the upper sleeve becomes subjected to the flow of fluid to the cementing port means the diffuser groove diffuses this flow thereby inhibiting damage to the seal means.

24. A method for alleviating an hydraulic lock above a device sealed in a wellbore, the device having a central bore therethrough permitting fluid communication between a first space above the device and a second space apart from the first space, the method comprising the steps of permitting fluid trapped in a first space above the device upon closure of the central bore to the flow of fluid therethrough to flow into a channel extending through the device, the channel in fluid communication with the first space and with a second space apart from the first space, contacting a pressure responsive member with the trapped fluid, the pressure responsive member sealingly disposed across the channel to close it off to actuate the pressure responsive member to open the channel so that fluid entrapped in the first space may flow from the first space to the second space.

25. The method of claim 24 wherein the pressure responsive member is a disc which is rupturable in response to a predetermined fluid pressure.

26. The method of claim 25 in which a puncture pin disposed adjacent the disc is movable to puncture the disc to permit the flow of trapped fluid.

27. The method of claim 26 in which a movable member disposed above the puncture pin moves in response to a plug pushing on the movable member, the movable member movable to contact the puncture pin and push it through the disc.

28. The method of claim 24 wherein the pressure responsive member is a piston mounted in the channel and held therein by a shear pin which breaks at a predetermined fluid pressure to permit the piston to move thereby opening the channel to the flow of trapped fluid.

* * * * *